US006325895B1

(12) United States Patent
Graf

(10) Patent No.: US 6,325,895 B1
(45) Date of Patent: Dec. 4, 2001

(54) PAPER-MAKING MACHINE WITH AN AIR PRESS BELT RUN

(75) Inventor: Edwin X. Graf, Menasha, WI (US)

(73) Assignee: Voith Sulzer Paper Technology North America, Inc., Appleton, WI (US)

( * ) Notice: Subject to any disclaimer, the term of this patent is extended or adjusted under 35 U.S.C. 154(b) by 0 days.

(21) Appl. No.: 09/592,512

(22) Filed: Jun. 12, 2000

(51) Int. Cl.[7] ..... D21F 11/00

(52) U.S. Cl. ..... 162/205; 162/358.1; 162/360.3

(58) Field of Search ..... 162/358.1, 358.2, 162/358.3, 358.4, 358.5, 359.1, 360.2, 360.3, 203, 205, 273, 274, 306; 100/118, 153, 162 B; 34/115, 116, 117; 226/44; 242/413.4, 418; 156/389; 425/367

(56) References Cited

U.S. PATENT DOCUMENTS 3,246,365 * 4/1966 Kloender ..... 425/367
3,293,121 * 12/1966 Martin ..... 162/358.3
3,528,883 * 9/1970 Lundin ..... 162/358.1
4,160,694 * 7/1979 Futcher ..... 162/256
4,173,249 * 11/1979 Holkko ..... 162/358.3
4,675,079 * 6/1987 Webster ..... 162/360.1
4,880,502 * 11/1989 Wedel ..... 162/359
5,663,510 * 9/1997 Niemann et al. ..... 73/862.55

* cited by examiner

*Primary Examiner*—Peter Chin
*Assistant Examiner*—Eric Hug
(74) *Attorney, Agent, or Firm*—Taylor & Aust, P.C.

(57) ABSTRACT

A device for processing a continuous fiber web includes a membrane, a pressurized enclosure, a tension roll and a guide roll. The pressurized enclosure includes at least a first roll and defines an air press chamber. The first roll partially defines the air press chamber and carries the membrane. The tension roll also carries the membrane and is movable toward and away from the first roll. The guide roll further carries the membrane and is positioned between the first roll and the tension roll. The guide roll has opposite ends, at least one of which is pivotable toward and away from the first roll.

18 Claims, 3 Drawing Sheets

PAPER-MAKING MACHINE WITH AN AIR PRESS BELT RUN

BACKGROUND OF THE INVENTION

1. Field of the Invention

The present invention relates to paper-making machines, and, more particularly, to paper-making machines with an air press system.

2. Description of the Related Art

Press systems have long been relied upon to aid in the dewatering and in the forming of paper. Mechanical systems employing a series of rolls, shoes, etc. are the most common. More recently, development of air press systems has begun.

Semipermeable membranes have been used to convey paper webs since such membranes provide channels through which water may be conveyed away from a paper web. An example of such a membrane in the form of a laser drilled forming fabric is described in U.S. Pat. No. 5,837,102 (Graf), entitled "Perforated and Embossed Sheet Forming Fabric," issued Nov. 17, 1998, which is assigned to the assignee of the present invention and herein incorporated by reference.

SUMMARY OF THE INVENTION

The present invention provides an apparatus for processing a continuous fiber web that provides a guide roll for controlling a lateral position of the membrane on a fiber web roll and provides a tension roll for controlling a degree of slack and thus, conversely, an amount of tension in the membrane.

The invention comprises, in one form thereof, a device for processing a continuous fiber web that includes a membrane, a pressurized enclosure, a tension roll and a guide roll. The pressurized enclosure includes at least a first roll and defines an air press chamber. The air press chamber has a perimeter with the first roll partially defining that perimeter. Additionally, the first roll carries the membrane. The tension roll also carries the membrane and is movable toward and away from the first roll. The guide roll further carries the membrane and is positioned between the first roll and the tension roll. The guide roll has opposite ends, at least one of which is pivotable toward and away from the first roll.

An advantage of the present invention is that a longer membrane may be accommodated, thus promoting longer belt life by reducing the time spent in the nips by any given section of the membrane.

Another advantage is a centering mechanism is available that counteracts the tendency of the membrane to meander along the length of a fiber web roll.

Yet another advantage is that contact with and eventual loosening of the end seals of an air press belt run may be avoided by keeping the membrane generally centered.

A yet further advantage is that a seal at each nip between mating rolls is better maintained by using crown compensating rolls as the rolls.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
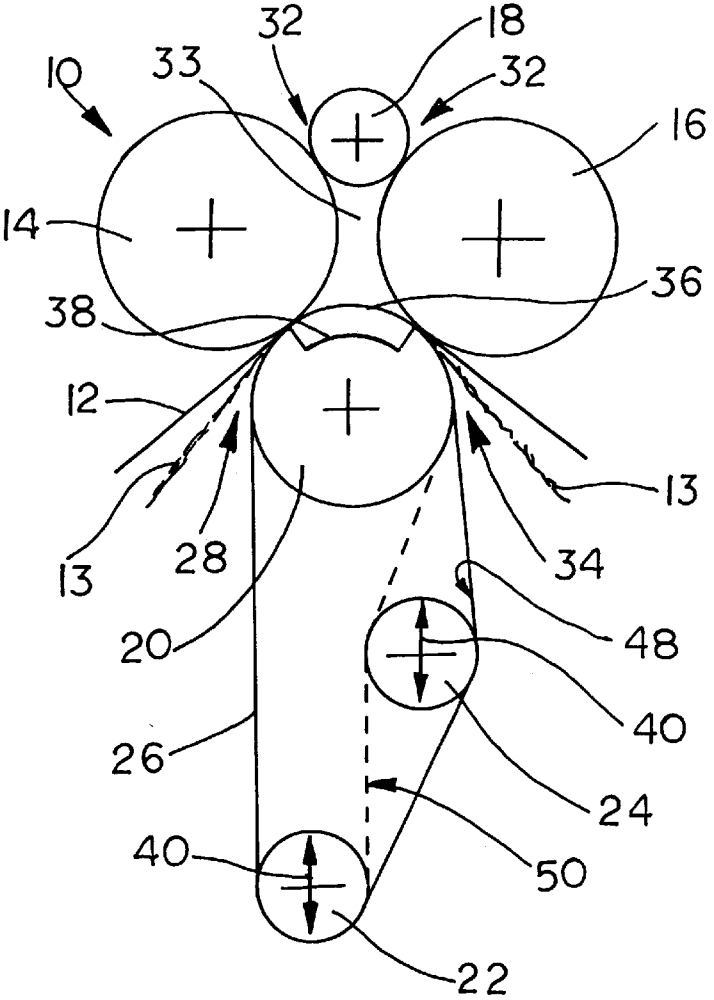
FIG. 1 is a schematic view of a first embodiment of an air press system of the present invention.

Referring now to the drawings, and more particularly to FIG. 1, there is shown an air press assembly 10 including a felt 12 for carrying a continuous fiber web 13, a plurality of rolls 14–20, a tension roll 22, a guide roll 24, and a membrane 26.

Plurality of rolls 14–20 are arranged for cooperative rotation and include a first press roll 14, a second press roll 16, a first cap roll 18, and a second cap roll 20. First press roll 14 is opposed to and spaced apart from second press roll 16, and first cap roll 18 is opposed to and spaced apart from second cap roll 20. First cap roll 18 and second cap roll 20 each are positioned adjacent to and form roll nips 28–34, respectively, with each of first press roll 14 and second press roll 16.

First cap roll 18 is smaller in diameter than second cap roll 20. By having such a relatively small diameter, first cap roll 18 may more easily create a sealing engagement with first press roll 14 and second press roll 16 at roll nips 30 and 32, respectively. Forming such a sealing engagement is important when a pressurized fluid, such as compressed air, is injected (not shown) into a space 33 between rolls 14–20 of air press assembly 10. The pressure created thereby may be selected depending on the specific application and, e.g., may be about 100 psig.

Rolls 14–20 each can be one of a crown compensating, shoe, swimming, or piston type roll. Rolls 14–20 are preferably crown compensating rolls since crown compensating rolls are structured and arranged to prevent deflection at the center of the rolls. By preventing deflection at the center of the rolls, leakage between the rolls due to such deflection is likewise minimized, if not prevented. Such deflection, if not compensated for, can otherwise act as a significant leakage source at roll nips 28–34 since rolls 14–20 are usually 3 ft. to 40 ft. long and consequently may be prone to sagging.

In the preferred embodiment shown in the drawings, second cap roll 20 is a crown compensating roll. Crown compensating roll 20 has an outer roll surface 36, and the section of outer roll surface 36 between roll nips 28 and 34 has been labeled as nip line 38. Since second cap roll 20 is crown compensating, a seal may be maintained between outer roll surface 36 and membrane 26 along nip line 38. This crown compensation helps counter the effect of gravity, which tends to cause second cap roll 20 to pull away from mating rolls 14 and 16. This gravitational effect is not as critical for first cap roll 18, which actually rests along its length upon rolls 14 and 16. Broadly stated, it is preferable that at least the lowermost positioned roll within air press assembly 10 is crown compensated due to such gravitational effects.

Figure 2:
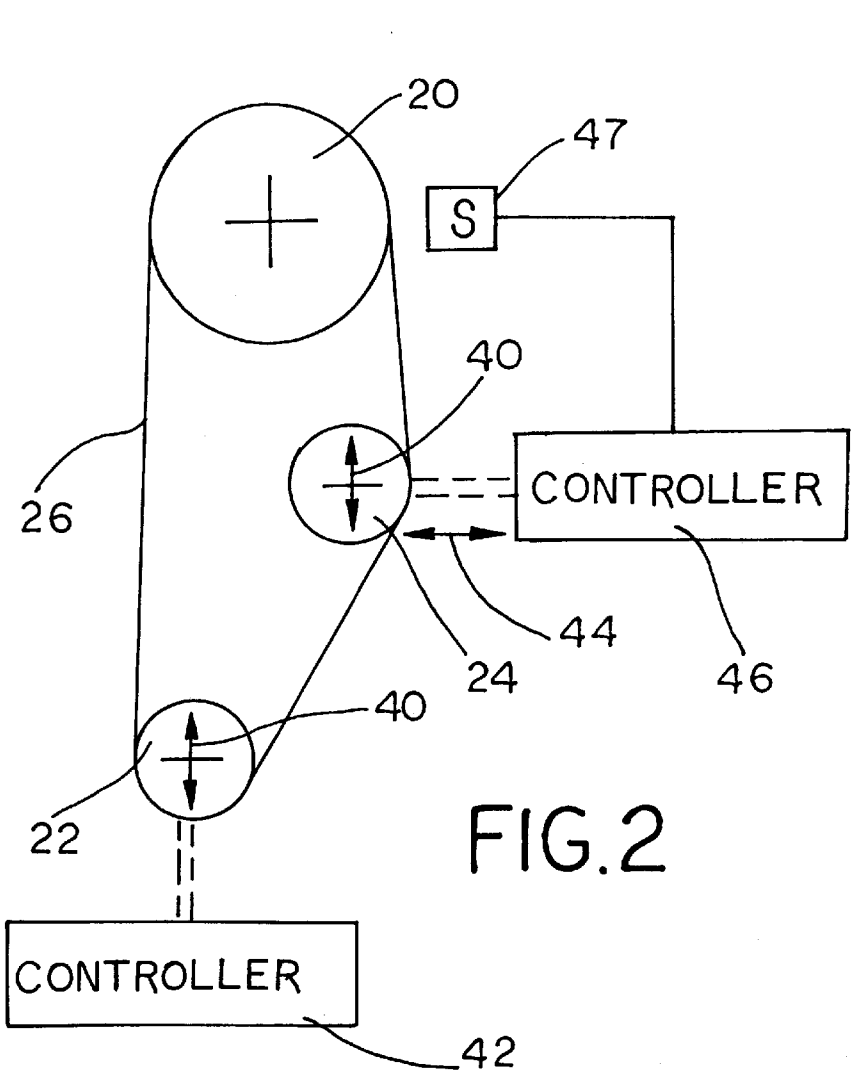
FIG. 2 is a schematic view of the membrane run shown in FIG. 1.

Tension or stretch roll 22 is movable in a first direction 40 (shown schematically in FIG. 1) extending toward and away from plurality of rolls 14–20. Such movement of tension roll 22 is generated by a first position controller 42 (FIG. 2).

Guide roll 24 is pivotable about an axis in first direction 40 and is movable in second direction 44 extending transverse to plurality of rolls 14–20. Such movement of guide roll 24 is controlled by a second position controller 46.

Guide roll 24 is shown to be cylindrical in the drawings. However, the outer longitudinal surface of guide roll 24 may be any one of cylindrical, convex, or concave, based upon necessary design criteria.

Second position controller 46 is operatively connected to a membrane position sensor (S) 47. Membrane position sensor 47 detects a lateral position of membrane 26 upon second cap roll 20. Membrane position sensor 47 may be any one of various types of position sensors, including, but not limited to, opto-electronic, inductive, mechanical, and sonic type sensors.

Membrane 26 is positioned so as to wrap around and be in movable contact with both second cap roll 20, tension roll 22 and guide roll 24. Membrane 26 is preferably semipermeable so that it conveys a certain amount of air into nip 28 between second cap roll 20 and first press roll 14. As membrane 26 becomes compressed by rolls 14 and 20 at nip 28, the air trapped within membrane 26 is forced outward and thereby pushes moisture into felt 12 carrying paper web 13. Thus, membrane 26 and rolls 14 and 20 coact in a manner similar to a piston. An additional effect of this air compression is that it tends to force felt 12 and paper web 13 away from membrane 26 and onto first press roll 14, opposing membrane 26. This effect helps felt 12 and paper web 13 achieve the proper feed path upon entering air press assembly 10.

Tension roll 22 is positionable in first direction 40 so as to maintain tension in membrane 26 and thereby avoid a slack run. A slack run of membrane 26 could damage both membrane 26 itself as well as fiber web 13.

Additionally, guide roll 24 is stationed so as to be in coacting contact with membrane 26. Preferably, guide roll 24 is in contact with inner membrane surface 48. Alternatively, guide roll 24 instead contacts outer membrane surface 50 (shown in phantom in FIG. 1).

It is preferable to employ a membrane 26 of an increased length since an increased membrane length allows longer membrane life. The increased membrane life is possible since any given length of a longer membrane 26 would spend less time in roll nips 28–34 during a revolution of membrane 26 than the same given length of a shorter membrane. The increased length of membrane 26 is accommodated by the combined presence of tension roll 22 and guide roll 24. Tension roll 22 and guide roll 24 in conjunction with second cap roll 20 can generate an extended path over which membrane 26 may travel.

During the operation of air press assembly 10, fiber web 13 is fed into roll nip 28 and is conveyed along a section of first press roll 14 which faces second press roll 16 until reaching roll nip 30. Upon reaching roll nip 30, fiber web 13 is carried on a section of first cap roll 18 which generally faces away from plurality of rolls 14–20. Once fiber web 13 enters roll nip 32, fiber web 13 travels along a section of second press roll 16 which faces first press roll 14 and remains in contact therewith until after exiting through roll nip 34.

Concurrent with the feeding of fiber web 13 through plurality of rolls 14–20, membrane 26 is conveyed around second cap roll 20 and tension roll 22 and against guide roll 24. Membrane 26 interacts with fiber web 13 at roll nips 28 and 34.

During operation, membrane 26 has a tendency to meander back and forth along the length of second cap roll 20. In fact, use of a longer membrane as per this invention tends to magnify the effect of the natural tendency of a membrane to oscillate laterally along a roll through multiple membrane cyclings. This tendency is offset by sensing a position of membrane 26 using membrane position sensor 47 and, as necessary, adjusting the pivot angle of guide roll 24 using second position controller 46 to counteract the tendency to meander and thereby generally laterally center membrane 26 on second cap roll 20. Guide roll 24 may further be moved in second direction 44 by second position controller 46, for example, to optimize the membrane centering capability thereof or to ease a changeover of membrane 26.

Figure 3:
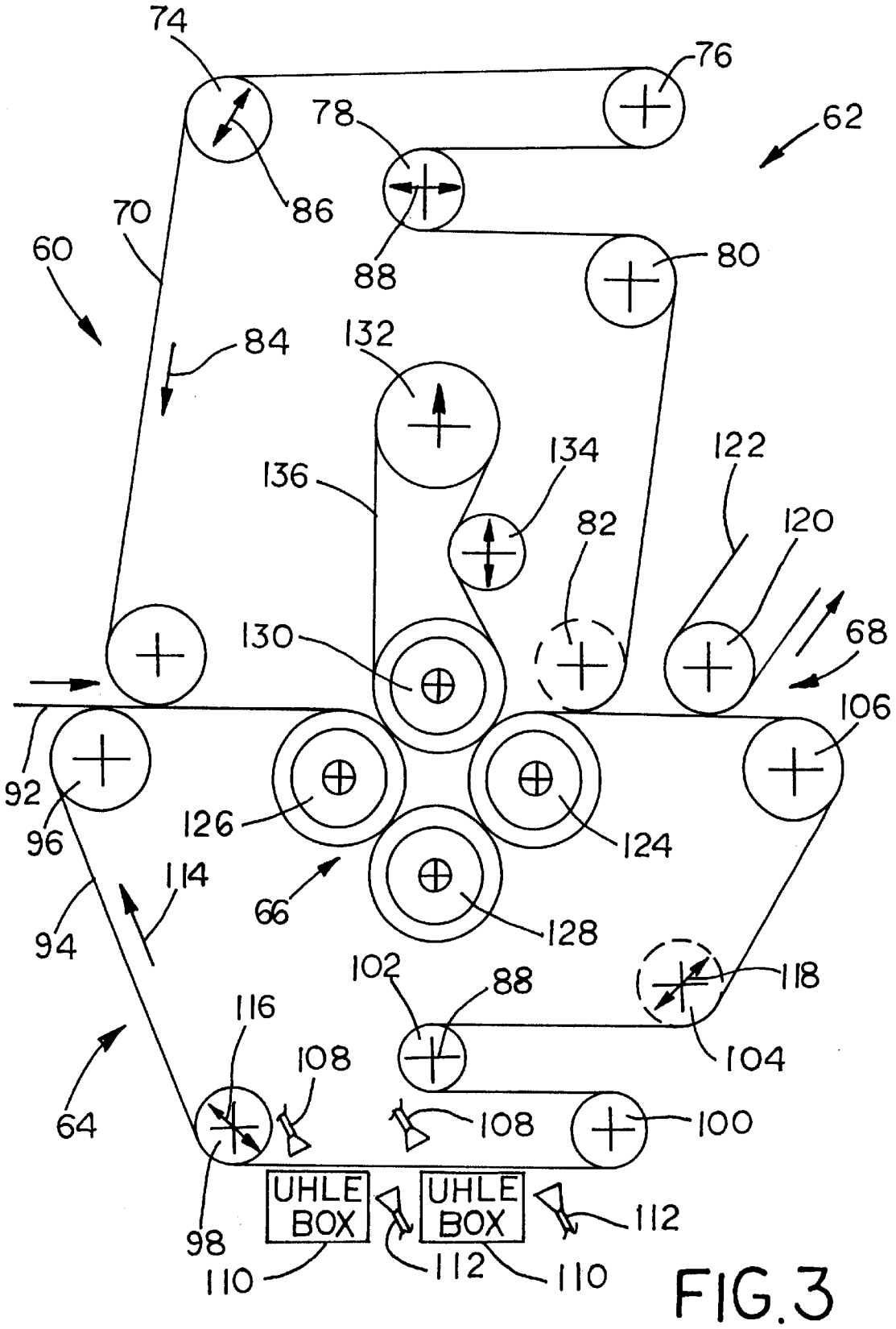
FIG. 3 is a schematic view of a second embodiment of a paper web processing unit of the present invention.

A second embodiment of the present invention, shown in FIG. 3, depicts a schematic system view of a paper web processing unit 60. Paper web processing unit 60 includes an upper felt run 62, a lower felt run 64, an air press assembly 66, and a transfer device 68.

Upper felt run 62 includes an upper felt 70 and a plurality of rolls 72–82. At least one of rolls 72–82 is mounted to a drive shaft (not shown) in order to power movement of upper felt 70 in first travel direction 84 through upper felt run 62. In the embodiment shown in FIG. 3, roll 74 is a guide roll movable about pivot direction 86, while roll 78 is a stretcher roll movable in second direction 88, which is essentially equivalent to second direction 44 in the first embodiment. Roll 82 is a pick-up roll, also movable in second direction 88.

Figure 4:
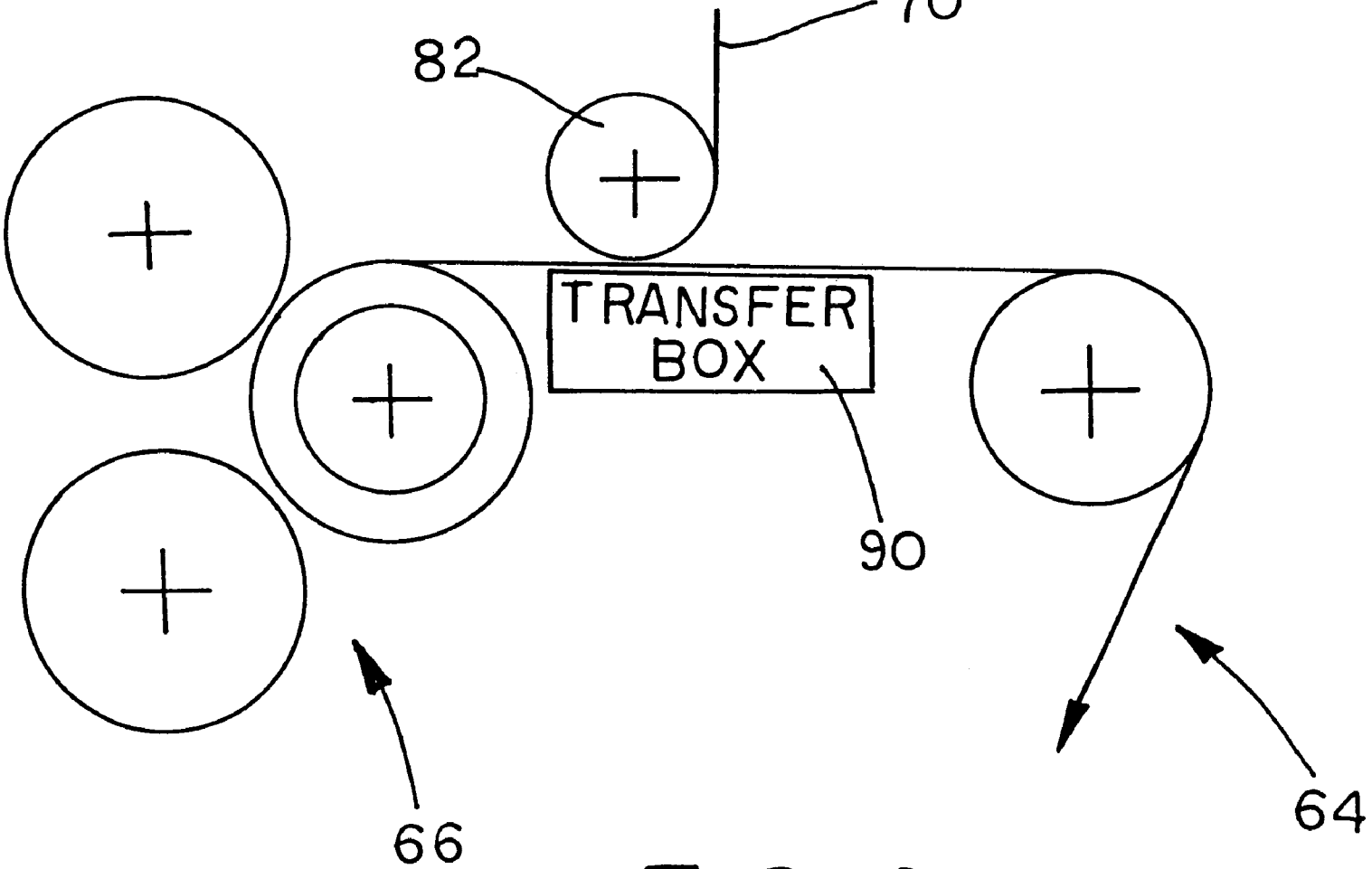
FIG. 4 is a schematic view depicting an alternate embodiment of an upper felt transfer section shown in FIG. 3.

Alternatively associated with upper felt run 62 adjacent to pick-up roll 82 is a transfer box 90, shown in FIG. 4. Transfer box 90 applies a vacuum to paper web 92 and lower felt 94 to ensure that paper web 92 remains on lower felt 94 and is not transferred upward along with upper felt 70 by pick-up roll 82 after upper felt 70, paper web 92 and lower felt 94 have passed through and beyond air press assembly 66.

Lower felt run 64 includes a lower felt 94, plurality of rolls 96–106, cleaning showers 108, Uhle boxes 110 and lube showers 112.

Rolls 96–106 include at least one roll which is mounted to a drive shaft (not shown) in order to power movement of lower felt 70 in second travel direction 114 through lower felt run 64. In the embodiment shown in FIG. 3, roll 98 is a guide roll movable in pivot direction 116, and roll 104 is a guide roll movable in pivot direction 118. Roll 102 is a tension roll movable in second direction 88.

Cleaning showers 108, Uhle boxes 110, and lube showers 112 are provided to maintain lower felt 94. Cleaning showers 108 rinse out of lower felt 94 residual paper fibers and chemicals which may remain from a previous paper web transfer cycle. Uhle boxes 110 condition lower felt 94 between transfer cycles. Lube showers 112 are used to keep lower felt 94 lubricated when paper web processing unit 60 is not in a production mode.

Transfer device 68 includes a suction pick-up roll 120 and a transfer membrane 122. Transfer device 68 is positioned downstream from air press assembly 66 and is configured for moving paper web 92, now densified upon passing through air press assembly 66, onto a next part of the paper-making process.

Air press assembly 66 is as substantially described previously in relation to the first embodiment shown in FIGS. 1 and 2. Air press assembly 66 includes rolls 124–134 and membrane 136, which correspond and function similar to rolls 14–24 and membrane 26.

During operation of paper web processing unit 60, paper web 92 is introduced between upper felt 70 and lower felt 94 at web entry point 138. Paper web 92 is then conveyed along with upper felt 70 and lower felt 94 through air press assembly 66, where paper web 92 is densified. Upon exiting air press assembly 66, upper felt 70 is directed away from paper web 92 and lower felt 94 at roll 82. At the next proceeding station downstream of air press assembly 66, densified paper web 92 is suctioned off of lower felt 94 by suction pick-up roll 120 and transported to a next part of the paper-making process by transfer membrane 122. Lower felt 94 continues on through lower felt run 64.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for processing a continuous fiber web, comprising:

a membrane, said membrane being semipermeable;

a pressurized enclosure including at least a first roll, said pressurized enclosure defining an air press chamber, said air press chamber having a perimeter, said first roll partially defining said perimeter of said air press chamber, said first roll carrying said membrane, said first roll being one of a plurality of rolls arranged for cooperative rotation, said plurality of rolls together defining said perimeter of said air press chamber, each set of adjacent rolls of said plurality of rolls having a nip therebetween;

a felt for carrying the fiber web, said at least said first roll conveying said felt into and through said air press chamber;

a tension roll carrying said membrane, said tension roll being movable toward and away from said first roll; and a guide roll carrying said membrane, said guide roll positioned between and adjacent to each of said first roll and said tension roll, said guide roll having opposite ends, at least one of said opposite ends being pivotable toward and away from said first roll.

2. The apparatus of claim 1, wherein said plurality of rolls further includes a second roll, a third roll, and a fourth roll, said first roll being opposed to and spaced apart from said third roll, said second roll being opposed to and spaced apart from said fourth roll, said first roll and said third roll each positioned adjacent to and forming a said nip with each of said second roll and said fourth roll.

3. The apparatus of claim 1, wherein said membrane has a tension associated therewith and wherein said apparatus further comprises a first controller configured for adjusting a position of said tension roll and thereby adjusting the tension of said membrane.

4. The apparatus of claim 1, wherein said guide roll is structured and arranged for selectively displacing said membrane and controlling a lateral position thereof relative to said first roll.

5. The apparatus of claim 4, further comprising a membrane position sensor structured and arranged to sense a lateral position of said membrane on said first roll and to output a related membrane position signal and further comprising a second controller configured for receiving said membrane position signal and adjusting a position of said guide roll to thereby impart said lateral position control on said membrane based upon said membrane position signal.

6. The apparatus of claim 1, wherein said membrane has an inner face and an outer face, said inner face contacting each of said first roll, said tension roll and said guide roll.

7. The apparatus of claim 2, wherein said first roll and said third roll each have a diameter, and wherein said diameter of said third roll is less than said diameter of said first roll.

8. The apparatus of claim 1, wherein said first roll is configured to convey the continuous fiber web into said air press chamber.

9. The apparatus of claim 1, wherein said membrane is laser-drilled.

10. An apparatus for processing a continuous fiber web, comprising:

a membrane, said membrane being semipermeable;

a pressurized enclosure including at least a first roll, said pressurized enclosure defining an air press chamber, said air press chamber having a perimeter, said first roll partially defining said perimeter of said air press chamber, said first roll carrying said membrane, said first roll being one of a plurality of rolls arranged for cooperative rotation, said plurality of rolls together defining said perimeter of said air press chamber, each set of adjacent rolls of said plurality of rolls having a nip therebetween, each of said plurality of rolls being a crown compensating roll;

a felt for carrying the fiber web, said at least said first roll conveying said felt into and through said air press chamber;

a tension roll carrying said membrane, said tension roll being movable toward and away from said first roll; and a guide roll carrying said membrane, said guide roll positioned between said first roll and said tension roll, said guide roll having opposite ends, at least one of said opposite ends being pivotable toward and away from said first roll.

11. An apparatus for processing a continuous fiber web, comprising:

membrane, said membrane being semipermeable;

a pressurized enclosure including at least a first roll, said pressurized enclosure defining an air press chamber, said air press chamber having a perimeter, said first roll partially defining said perimeter of said air press chamber, said first roll carrying said membrane, said first roll being one of a plurality of rolls arranged for cooperative rotation, said plurality of rolls together defining said perimeter of said air press chamber, each set of adjacent rolls of said plurality of rolls having a nip therebetween, said plurality of rolls further including a second roll, a third roll, and a fourth roll, said first roll being opposed to and spaced apart from said third roll, said second roll being opposed to and spaced apart from said fourth roll, said first roll and said third roll each positioned adjacent to and forming a said nip with each of said second roll and said fourth roll, said first roll being a crown compensating roll, said crown compensating roll having an outer roll surface, said nip between said crown compensating roll and said second roll defining a first nip and said nip between said crown compensating roll and said fourth roll defining a second nip, a portion of said outer surface between said first nip and said second nip thereby defining a nip line, said crown compensating roll being configured to maintain a seal at said nip line;

a felt for carrying the fiber web, said at least said first roll conveying said felt into and through said air press chamber;

a tension roll carrying said membrane, said tension roll being movable toward and away from said first roll; and a guide roll carrying said membrane, said guide roll positioned between said first roll and said tension roll, said guide roll having opposite ends, at least one of said opposite ends being pivotable toward and away from said first roll.

12. An apparatus for processing a continuous fiber web, comprising:

a plurality of rolls arranged for cooperative rotation, at least one of said rolls being a crown compensating roll, said plurality of rolls including a first roll, each pair of adjacent rolls forming a nip therebetween, said plurality of rolls thereby defining a plurality of nips, said plurality of rolls and said plurality of nips together defining an air press chamber;

a felt for carrying the fiber web, said plurality of rolls together conveying said felt into, through, and out of said air press chamber;

a tension roll movably positioned at a distance away from said first roll;

a guide roll movably positioned between said first roll and said tension roll; and a membrane carried by said first roll, said tension roll and said guide roll, said first roll carrying said membrane into and out of said air press chamber, said membrane remaining in contact with said first roll while in said air press chamber, said membrane being semipermeable.

13. The apparatus of claim 12, wherein said guide roll has a set of opposite ends, at least one of said opposite ends being selectively pivotable toward and away from said first roll, said guide roll being structured and arranged for selectively displacing said membrane and controlling a lateral position thereof relative to said first roll.

14. The apparatus of claim 12, further comprising a tension roll position controller structured and arranged for controlling a distance between said tension roll and said first roll and thereby controlling a degree of slack in said membrane.

15. An apparatus for processing a continuous fiber web, comprising:

a plurality of rolls arranged for cooperative rotation, at least one of said rolls being a crown compensating roll, said plurality of rolls including a first roll, said first roll being a crown compensating roll, each pair of adjacent rolls forming a nip therebetween, said plurality of rolls thereby defining a plurality of nips, said plurality of rolls and said plurality of nips together defining an air press chamber;

a felt for carrying the fiber web, said plurality of rolls together conveying said felt into, through, and out of said air press chamber;

a tension roll movably positioned at a distance away from said first roll;

a guide roll movably positioned between said first roll and said tension roll; and a membrane carried by said first roll, said tension roll and said guide roll, said first roll carrying said membrane into and out of said air press chamber, said membrane remaining in contact with said first roll while in said air press chamber, said membrane being semipermeable said first roll being a crown compensating roll.

16. An apparatus for processing a continuous fiber web, comprising:

a plurality of rolls arranged for cooperative rotation, at least one of said rolls being a crown compensating roll, said plurality of rolls including a first roll, each pair of adjacent rolls forming a nip therebetween, said plurality of rolls thereby defining a plurality of nips, said plurality of rolls and said plurality of nips together defining an air press chamber, a lowermost positioned roll of said plurality of rolls being a crown compensating roll;

a felt for carrying the fiber web, said plurality of rolls together conveying said felt into, through, and out of said air press chamber;

a tension roll movably positioned at a distance away from said first roll;

a guide roll movably positioned between said first roll and said tension roll; and a membrane carried by said first roll, said tension roll and said guide roll, said first roll carrying said membrane into and out of said air press chamber, said membrane remaining in contact with said first roll while in said air press chamber, said membrane being semipermeable.

17. A method of feeding a fiber web through an air press membrane run apparatus, said method comprising the steps of:

providing a plurality of rolls arranged for cooperative rotation and together defining an air press chamber therebetween, said plurality of rolls including at least a press roll and a fiber web roll, said press roll being positioned adjacent to and forming an inlet nip with said fiber web roll;

positioning a tension roll at a distance away from said fiber web roll at a side thereof opposite a location of said press roll;

locating a guide roll between said fiber web roll and said tension roll;

carrying a membrane with said fiber web roll, said tension roll and said guide roll, said membrane being semipermeable;

circulating said membrane about said fiber web roll, said guide roll, and said tension roll, said membrane entering said air press chamber at said inlet nip, said membrane maintaining contact with said fiber web roll while in said air press chamber;

feeding said fiber web on a felt through said inlet nip, said fiber web being guided on said felt through said inlet nip and into said air press chamber; and adjusting an angular position of said guide roll to selectively displace said membrane and thereby substantially center said membrane laterally along said fiber web roll.

18. The method of claim 17, further comprising the step of adjusting a position of said tension roll to decrease a slack in said membrane and thereby increase a tension therein.

* * * * *